United States Patent [19]

Chavanat et al.

[11] 3,967,155

[45] June 29, 1976

[54] ELECTRONIC FREQUENCY TUNING MAGNETRON

[75] Inventors: Paul Chavanat; Bernard Epsztein; Georges Mourier, all of Paris, France

[73] Assignee: Thomson-CSF, Paris, France

[22] Filed: Dec. 23, 1974

[21] Appl. No.: 535,715

[30] Foreign Application Priority Data

Dec. 28, 1973 France ..... 73.46957

[52] U.S. Cl. ..... 315/39.55; 313/103 R; 315/5.12; 315/39.51; 315/39.57; 333/99 MP; 331/90

[51] Int. Cl.[2] ..... H01J 25/50

[58] Field of Search ..... 315/5.12, 39.51, 39.55, 315/39.57; 313/103, 105; 333/99 MP; 331/90

[56] References Cited

UNITED STATES PATENTS

| | | | |
|---|---|---|---|
| 2,535,137 | 12/1950 | Jervis | 313/105 X |
| 2,613,335 | 10/1952 | Fremlin et al. | 313/103 X |
| 2,674,694 | 4/1954 | Baker | 313/103 X |
| 3,278,865 | 5/1963 | Forrer | 333/99 MP |
| 3,312,857 | 4/1967 | Farnsworth | 315/5.12 X |
| 3,748,592 | 7/1973 | Pickering | 333/99 MP |

*Primary Examiner*—Saxfield Chatmon, Jr.
*Attorney, Agent, or Firm*—Roland Plottel

[57] ABSTRACT

Cavity resonator electronic tubes, in particular magnetrons, with an electronic tuning system. The tuning systems in accordance with the invention consist of multipactor elements arranged directly within the resonant volumes of the tube cavities. Frequency tuning can be effected either by switching between two predetermined frequencies or by continuous change of the frequency.

12 Claims, 9 Drawing Figures

ELECTRONIC FREQUENCY TUNING MAGNETRON

The present invention relates to electronic tubes of resonant cavity type, such for example as magnetrons, which can be frequency-tuned by means of electronic tuning systems the control of which is quick and straight-forward.

Magnetrons of this kind are extremely useful, for example, in the transmitters of radar systems where it is generally necessary to be able to effect fast control either of operations of switching the frequency of the transmitted signals, or of continuous frequency variations in the context for example of pulse compression.

The need for a fast control means that mechanical tuning systems are virtually out of the question.

Various systems of electronic tuning, based upon different principles, have already been utilised.

One of them, described in French Pat. No. 72.15944, filed on May 4, 1972 by the company "English electric valve company limited", makes it possible for a magnetron to oscillate at one or the other of two predetermined frequencies by the use of an effect described in said patent as "discharge under the effect of multiple impacts" and more generally known by the expression "multipactor" effect. In said patent, an auxiliary cavity located outside the anode of the magnetron is coupled with one of the cavities of the anode through an inductive coupling loop. In this auxiliary cavity there are arranged mutually opposite one another two flat electrodes one of which is heated in order to emit electrons and both of which are capable of emitting secondary electrons with an emission coefficient greater than unity. These electrodes, furthermore, are arranged in the auxiliary cavity in such a fashion that the high frequency field created there by the coupling loop, normally produces between the electrodes a discharge of the "multipactor" type. The presence of this discharge between the two electrodes means that the auxiliary cavity is virtually short-circuited and that the frequency of the magnetron is effectively that determined by its principal cavities alone.

By contrast, if, between said two electrodes, a given direct voltage is applied, the "multipactor" effect disappears, the auxiliary cavity ceases to be short-circuit and therefore modifies the resonance frequency of the magnetron.

Thus, depending upon whether or not a direct voltage of given level is applied between the two electrodes installed in the auxiliary cavity, one or the other of two given resonances is obtained and the magnetron oscillates at one or the other of these two frequencies.

A major drawback of these systems resides in the fact that the variation of the frequency is produced by the addition, to the system of principal cavities of the magnetron, of an auxiliary cavity coupled to one of the principal cavities. The frequency variation which it is thus possible to achieve is limited, in other words, by the presence of the coupling device, the frequency shift introduced by the auxiliary cavity when it is not short-circuited, being limited by the coupling coefficient of the device.

One object of the present invention is to design electronic tubes of cavity resonator type, such as magnetrons, which can be tuned electronically by the use of the multipactor effect but do not exhibit the aforesaid drawback.

To do this and in accordance with the invention, controllable multipactor effect devices are arranged in the inside of the resonant cavities of the tubes which are to be tuned, in order to vary the resonance frequencies of these cavities.

According to the invention there is provided in a high frequency electronic tube comprising resonant cavities, at least a multipactor element disposed in the resonant space of one at least of said cavities, said multipactor element comprising two parallel electrodes facing each other and capable of emitting secondary electrons with a secondary emission coefficient $\delta$ greater than unity, said multipactor element being so dimensioned and positioned in said resonant space that the high frequency electric wave developed in said tube when operating provides between said electrodes of said multipactor element, a high frequency electric field perpendicular to said electrodes and gives rise to the occurrence there of a variable multipactor discharge.

Other features of the invention will become apparent from the ensuing description given by way of non-limitative example and illustrated by the attached figures where:

Figure 1:
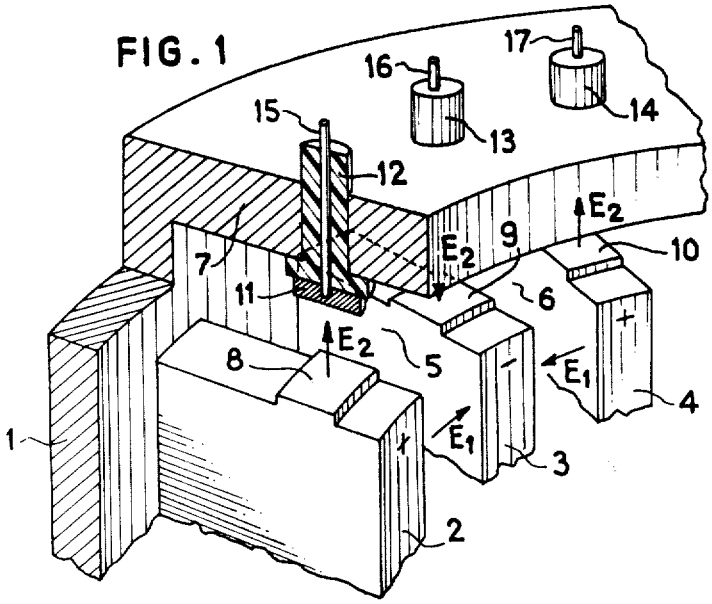
FIG. 1 is a schematic perspective view of part of the anode of a vane magnetron, comprising a multipactor element tuning system in accordance with the invention.

Before going into more detail in relation to different embodiments of microwave tubes and in particular improved magnetrons in accordance with the invention, a brief reminder will be given of the nature of the "multipactor" effect and the manner in which it can be controlled.

Generally speaking the "multipactor" effect can be produced between two mutually opposite electrodes located in an enclosure which is at a low pressure, the electrodes being capable of emitting secondary electrons with a secondary emission coefficient greater than unity, and constituting what will in the following be described as a "multipactor element". The characteristic discharge of the "multipactor" effect can be produced and maintained, if, between the two electrodes of the element, there is a suitable high frequency electric field.

In other words, if, when an electron leaves one of the two electrodes of the element, the electric field is such that it accelerates it towards the other electrode of the element, said accelerated electron will strike said other electrode and will liberate secondary electrons from it. If, at this instant, the electric field changes direction, which is the same thing as saying that the half period T/2 of said field is equal to the transit time $\theta$ of the electrons from one electrode to the other, then the secondary electrons thus emitted will in turn be accelerated towards the first electrode where they themselves will knock out other secondary electrons, and so on, creating between the two electrodes of the element a continuous discharge. In the event that the secondary emission coefficient is greater than unity, and this is the case envisaged here, said discharge will be stabilised by the space charge effect.

This phenomenon has not been described in more detail here because it is well-known per se. Similarly, it is also well-known to control the disappearance of the discharge by withdrawing one of the conditions which govern the stability of the phenomenon, either by applying between the two electrodes of the element a direct voltage which artificially modifies the transit time $\theta$ of the electrons so that the synchronism condition $\theta = T/2$ referred to earlier ceases to apply, or by applying a transverse magnetic field which, in modifying the trajectories of the electrons, also modifies their transit time $\theta$.

The cavity resonator tube tuning systems in accordance with the invention consist in introducing into the resonant space of said cavities, "multipactor" elements suitable arranged to experience the high frequency electric field present in said spaces, and in controlling said elements either by the use of an all or nothing kind of control system, manifesting itself in the presence or absence of the "multipactor" discharge, or by a continuous kind of control system which varies the intensity of said discharge. The improved tubes in accordance with the invention can thus be controlled in terms of their frequency, either in a discrete manner or in a continuous manner, as we shall now proceed to describe in relation to the example of a magnetron.

In FIG. 1, there has been schematically illustrated part of a vane type magnetron anode, the other elements of which, well-known per se, have not been illustrated.

On the cylindrical wall 1 of the anode, there are arranged vanes such as those 2, 3 and 4, which delimit between one another resonant cavities such as those 5 and 6.

Each of the cavities such as 5 and 6, is delimited on the one hand by the vanes, on the other by the wall 1 of the anode which extends here in the form of a cover or flange 7. The other end of the magnetron, which has not been shown, likewise comprises a flange closing off the bases of the cavities.

In the embodiment illustrated here, "multipactor" elements with two electrodes act directly upon the resonant spaces of the cavities.

To do this, the top part of each vane 2, 3 and 4 located opposite the cover 7, comprises a zone 8, 9 and 10 respectively, covered with a material capable of emitting secondary electrons with a secondary emission coefficient $\delta$ greater than unity. This zone can be constituted, for example, by a deposit of platinum, aluminium etc., and does duty as one of the two electrodes of multipactor elements. It can also be created by treating the material, copper for example, of which the vane is made, the treatment conferring on it the property of a secondary emission coefficient $\delta > 1$.

The other electrode of this element is constituted, for example, by a tablet 11 of a material capable of emitting secondary electrons under the same conditions; the tablet may for example be one of aluminium, alumina, copper or beryllium etc.

These tablets, such as that 11, are attached to the cover 7 of the magnetron in order to be located opposite corresponding electrodes 8, 9 and 10 and in order to be electrically insulated from the cover 7 which is at the direct potential carried by the anode assembly, for example a reference potential such as the earth potential.

For this reason, they are for example attached to an insulated component 12, 13 and 14 respectively, each of which is itself hermetically attached to the cover 7.

A conductor 15, 16 and 17 respectively, passes through these insulating components, without touching the cover 7 and is electrically connected to the corresponding electrode, 11, for example.

When the magnetron is operating, the microwave propagating through its anode, produces, for a given frequency and at that end of the vanes 2, 3 and 4 opposite to the cylindrical wall 1, high frequency voltages which, at a given instant, have, working from one vane to the next, equal amplitudes and opposite polarities, this corresponding as far as the wave is concerned to a vibrational state out of phase by 180° or $\pi$ radians; this mode of propagation, well-known as the $\pi$ mode, constitues the normal useful operating mode of the magnetron. The + and − signs shown in FIG. 1 at the end of the vanes 2, 3 and 4, symbolise the voltages at a given instant. With these voltages there correspond, within the cavities, high frequency electric fields such as the fields $E_1$ shown in the figure, the amplitude of which is a maximum towards the free ends of the vanes and diminishes as the wall 1 is approached, said wall, like the cover 7, being at a zero high frequency potential.

It will be clear therefore that between the electrodes of the multipactor elements, (elements 8, 11) there are high frequency electric fields symbolised by the arrows $E_2$. In other words, whilst the electrode 8, close to the free end of the vane 2, is at a substantial high frequency potential, the electrode 11 is at a virtually zero high frequency potential. The field $E_2$, directed perpendicularly to the planes of the two electrodes, changes direction in the rhythm of the high frequency waves generated by the magnetron.

In order for the multipactor elements such as those 8, 11, to give rise to multipactor discharges, it is merely necessary to position them and dimension them in such a way that the aforesaid conditions pertaining to the multipactor effect, are satisfied; it is possible in particular to regulate the amplitude of the field $E_2$ by varying the position of the multipactor elements along the top part of the vanes; the transit time $\theta$ of the electrons from one electrode to the other can be matched to the half period T/2 of the high frequency waves, by choice of the distance separating the two electrodes of the multipactor elements.

It should also be noted that in the embodiment described here, the electric field $E_2$ which is responsible for the multipactor effect, is parallel to the magnetic field associated with the magnetron; it is under these conditions that the multipactor discharge is strongest, the electrons participating in this discharge being deflected only slightly from the trajectory which takes them from one electrode to the other.

If no direct voltage is applied between the electrodes 8 and 11 and of the multipactor elements, that is to say if the conductors such as that 15 are at the direct reference potential of the anode assembly, then multipactor discharges will occur. The capacitances delimited by the top faces of the vanes (comprising the electrodes 8,

9 and 10) and the opposite parts of the cover 7, are then shunted by an inductive-resistive impedance due to the discharge.

If, to the conductor 15, for example a direct voltage which we can call the control voltage, is applied which is of sufficient level in relation to the direct reference potential, then a direct electric field parallel to the filed $E_2$ will be superimposed upon the latter and the transit time of the electrons between the electrodes will be modified. If this voltage is sufficiently high for the phenomenon to become unstable, then the discharge will disappear and the inductive-resistive impedance likewise.

Figure 2:
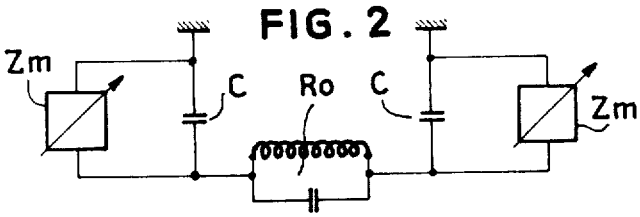
FIG. 2 is the equivalent diagram of a cavity equipped with the multipactor elements.

FIG. 2 shows the equivalent diagram of a cavity such as that 5, in which the two vanes 2 and 3 are equipped with multipactor elements 8, 11 and 9.

The oscillatory circuit Ro illustrates in the conventional way the resonant cavity itself, whilst the capacitors C represent the aforementioned capacitances and the variable impedances Zm represent the impedances which shunt the capacitances C when the discharges occur.

It is clear that in the absence of any multipactor discharges, the cavity having a certain impedance (circuit Ro + capacitances C) will resonate at a certain frequency, whilst in the presence of these discharges the cavity impedance is modified by the impedances Zm; the cavity will then resonate at a different frequency.

Thus, depending upon whether a direct voltage other than zero, is or is not applied to the conductors 15, 16, 17 etc., the cavities of the magnetron will resonate one or the other of two predetermined frequencies.

If the same direct control voltage is applied to all the conductors controlling the multipactor elements associated with each vane, the assembly of these conductors being for example connected by a conductor ring, then the magnetron will only effectively oscillate at one or the other of two predetermined frequencies.

If, on the other hand, this direct control voltage is not applied simultaneously to all the conductors, then the magnetron will be able to oscillate at some or others of several given, discrete frequencies.

Similarly, magnetrons can be designed in which not all the vanes are equipped with multipactor elements.

Moreover, it should be pointed out that if to the conductors such as 15, 16 and 17, direct control voltages are applied which are sufficient to modify the intensity of the discharge but insufficient to suppress it altogether, then the impedance of the cavities and the frequency of oscillation of the magnetron, can be varied in a continuous way.

In other words, if said control voltage of the multipactor elements is varied progressively, the transit time of the electrons involved in the discharge will be artificially modified; this modification is translated into terms of variations in the relative phase of the emitted electrons and the high frequency wave, the aforementioned conditions no longer being satisfied in respect of all the electrons in the discharge. The result is a progressive variation in the impedance Zm, a progressive variation in the resonance frequency of the corresponding cavity or cavities, and therefore a progressive variation in the frequency of the magnetron.

Figure 3:
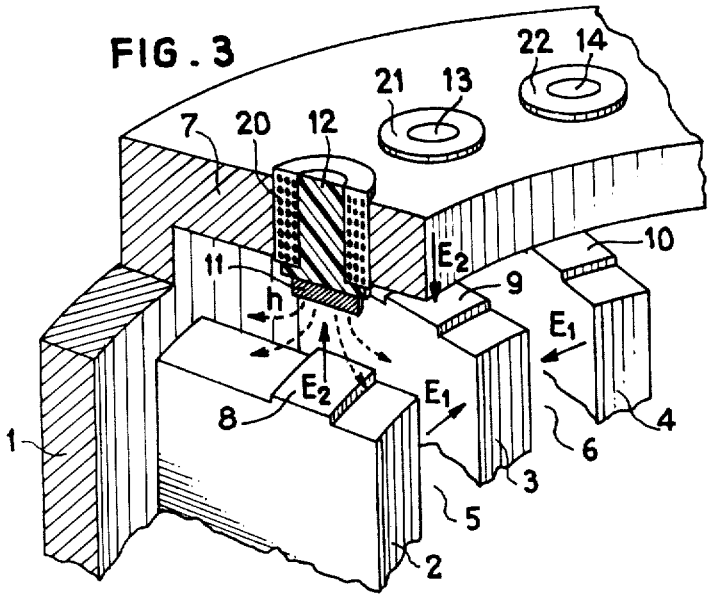
FIG. 3 is a schematic perspective view of a variant embodiment of FIG. 1.

FIG. 3 schematically illustrates part of a magnetron anode which, in terms of its general structure, is identical to that of FIG. 1 and which differs from the latter only in terms of the means used to control the multipactor elements. Here, in other words, instead of suppressing or modifying the discharge by the application of an auxiliary direct electric field between the electrodes of an element, said field resulting from the application of a control voltage between the two electrodes, the discharge is suppressed or modified by creating, between the electrodes, a magnetic field having a component parallel to the planes of the electrodes and of variable strength.

To do this, the conductors 15, 16 and 17 of FIG. 1 are replaced by coils 20, 21 and 22 supplied with direct current through connections which have not been shown, and surrounding insulating components 12, 13 and 14, these coils producing in the inter-electrode spaces of the multipactor elements magnetic fields *h* represented in respect of the element 8, 11, by broken-line arrows. These variable magnetic fields modify the trajectories of the electrons involved in the discharge and thus vary the impedance Zm of the multipactor elements.

The magnetrons described and illustrated here are vane-type magnetrons; it should be understood of course that the invention is applicable equally well to other types of magnetrons, as for exemple split-anode magnetrons or perforated anode magnetrons. In all cases, the multipactor elements are arranged above the solid parts separating the cavities.

Figure 4:
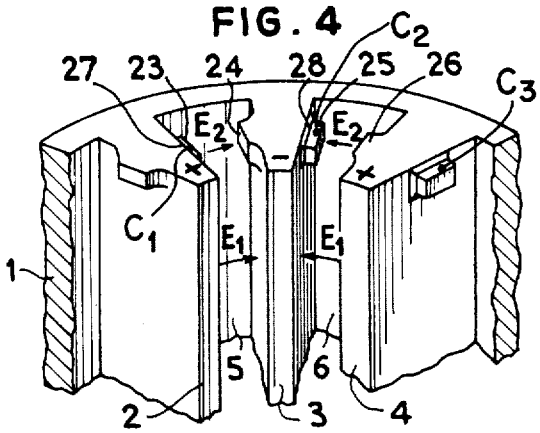
FIG. 4 is a schematic perspective view of a variant embodiment of the tuning system for a magnetron.

FIG. 4 illustrates highly schematically another embodiment of a magnetron anode in which the cavities are equipped with multipactor elements.

In this variant embodiment, the multipactor elements are assembled in parallel on the cavities 5 and 6 for example, their electrodes being disposed directly on the lateral faces (vertical in the figure) of the cavities.

A first electrode, 24 for example, of each element is formed on a protruberance arranged at one end of a vane 3.

The second electrode, 23 in this case, is constituted by a conductor element 23 attached to the vane 2 in order to be disposed opposite the electrode 24, the attachment being effected through the medium of an insulator 27.

Here, the multipactor elements are subjected to a high frequency electric field $E_2$ parallel to the field $E_1$ prevailing in the cavities. The drawback of this variant, in relation to those described earlier, is that since the magnetic field of the magnetron is perpendicular to the electric field $E_2$ producing the multipactor effect, the discharge cannot be as intense and the band of frequencies within which the magnetron will oscillate, is narrower.

Operation is the same as before; if no direct control voltage is applied between the two electrodes of the multipactor elements, the presence of discharges will modify the impedance of the cavities which will resonate at a frequence which differs from that at which they resonate when there is no multipactor discharge, that is to say when a direct control voltage is applied, through conductors C1, C2, C3 to the electrodes 23, 25 etc. If this control voltage varies progressively, then the same applies to the frequency of oscillation of the magnetron.

Figure 5:
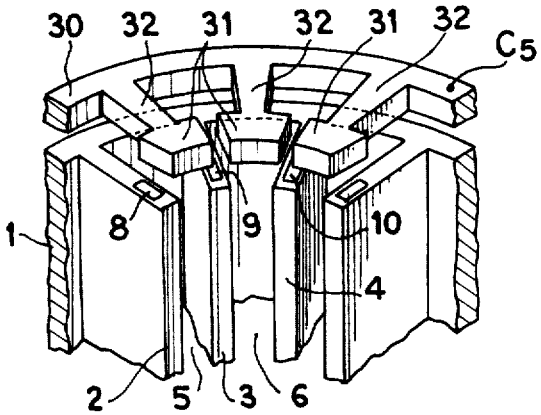
FIGS. 5 and 6 are schematic perspective views of part of a magnetron anode combining a tuning system in accordance with the present invention with auxiliary coupled lines which promote $\pi$ — mode operations.

FIG. 5 illustrates an anode 1 with vanes 2, 3 and 4, belonging to a magnetron, in which anode the multipactor elements operate in virtually the same way as those described earlier in relation to FIG. 1, and are combined with an auxiliary line 30 coupled to the vane anode. The function of this auxiliary line 30, which has also been patented by the present applicants in their U.S. Pat. No. 3,742,293 filed Dec. 15, 1971, is to facilitate the operation of the magnetron in the $\pi$-mode.

It may be used, as described here, to support the second electrodes of the multipactor elements, the first electrodes 8, 9 and 10 of which are disposed, as in the case of FIGS. 1 and 3 described earlier, on the top parts of the vanes 2, 3, 4 etc. These second electrodes are arranged beneath the ends of plates 31, opposite the electrodes 8, 9 and 10. They are all electrically interconnected, the plates 31 being connected by the arms 32 to the same ring 30. In this case, all that is possible is an overall control of the multipactor elements, the control voltage being applied to the assembly of the line 30 through conductor C5.

Figure 6:
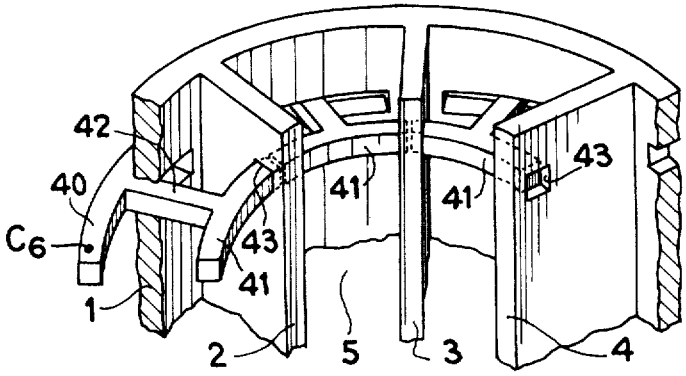

FIG. 6 illustrates a variant embodiment of FIG. 5 in which the auxiliary line 30 acting as support for the multipactor elements, is replaced by the auxiliary line 40, and has been described in the aforesaid patent of the applicants.

The multipactor elements are here arranged inside windows 43 formed in the vanes. The multipactor discharge, as already said, being more intense if the high frequency field responsible for it is parallel to the magnetic field of the magnetron, the surfaces doing duty as the electrodes of the multipactor elements will preferably be the surfaces of the windows 43, and the oppositely disposed surfaces of the bars 41 which are perpendicular to the magnetic field of the magnetron. Thus, each window 43 in which there are located tow ends of bars 41, can comprise four small multipactor elements, namely two at each arm end.

Here, again, the bars 41 are all connected to the same ring 40 by the rods 42, and overall control of the frequency of the cavities is effected by applying control voltage through conductor C6.

Figure 7:
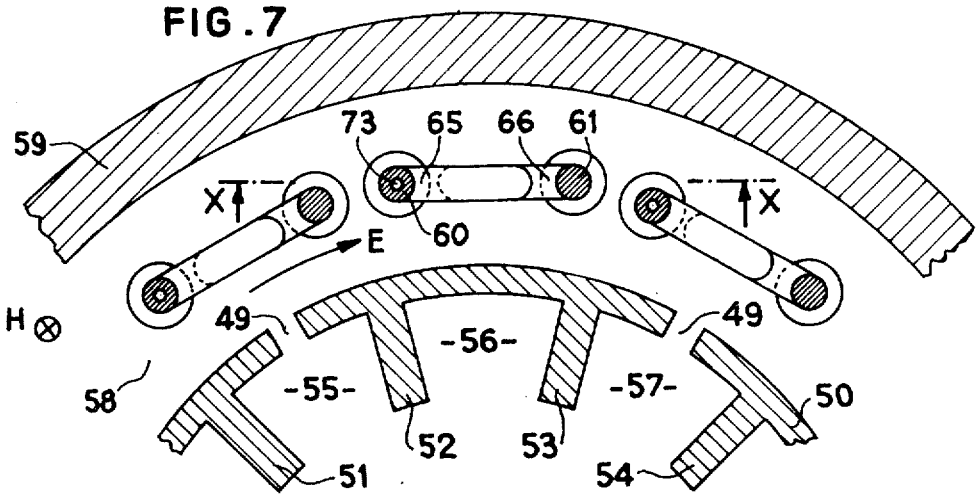
FIGS. 7 and 8 are schematic views of parts of a coaxial magnetron utilising a tuning system in accordance with the invention.
Figure 8:
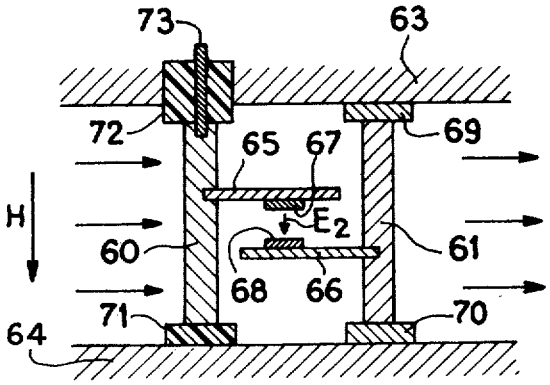

FIGS. 7 and 8, on the one hand, and 9 on the other, illustrate two possible applications of the tuning systems in accordance with the invention to a coaxial magnetron.

In FIG. 7, which is a plan view, there can be seen a coaxial magnetron anode comprising a tuning system employing multipactor elements. FIG. 8 is a sectional view taken on the line XX, through part of the anode, in particular a multipactor element.

The coaxial magnetron anode comprises, in a manner known per se, a cylindrical wall 50 carrying the vanes 51, 52, 53 and 54 which delimit the internal cavities 55, 56 and 57. Said cylindrical wall contains openings 49 in every second cavity, that is to say in the cavities where the high frequency wave is in-phase with the $\pi$ mode. These openings 49 serve to couple the cavities in which they are formed, with the external cavity 58 of the coaxial magnetron, said external cavity being constituted by the space defined between the cylindrical wall 50 and a second cylindrical wall 59 coaxial with the first. It is in this external cavity 58 where the high frequency energy generated in the magnetron is picked off.

Frequency tuning by the use of multipactor elements arranged in said external cavity can be achieved in a very efficient way, as will now be explained.

Parallel conductive bars 60 and 61 are attached between the two flanges 63 and 64 terminating the anode of the magnetron and each carrying a conductive plate or rod, 65 and 66. Said plates are parallel with the flanges 63 and 64, are disposed opposite one another and are shorter than the distance between the two bars 60 and 61. On their mutually opposite faces there are disposed two electrodes 67 and 68 which are the two electrodes of a multipactor element.

One of the two bars, 61 for example, is electrically connected to the flanges 63 and 64, the components 69 and 70 used to attach them being conductive. The other 60 is electrically insulated, the components 71 and 72 being insulators. Moreover, the component 72 is traversed by a conductor 73 electrically insulated from the flange 63 and connected instead to the bar 60.

A certain number of devices of the kind just described, are arranged in the external cavity 58 of the magnetron, in the manner indicated in FIG. 7.

The high frequency electric field is directed in this cavity in the manner indicated by the arrows E of FIGS. 7 and 8, whilst the magnetic field H of the magnetron is directed in the manner indicated by the arrows H.

Because of the arrangement of the bars and conductive plates on which the multipactor elements are assembled, the direction of the electric field between the electrodes 67 and 68 of an element, is deflected and the high frequency electric field $E_2$ between these electrodes is parallel to the magnetic field H so that, as stated earlier, the best conditions are thus created for the production of an intense multipactor discharge.

In order to vary the frequency of oscillation of the magnetron it is merely necessary to apply a direct control voltage to a conductor or conductors such as that 73. The variations in impedance which this produces in respect of the multipactor element or elements concerned, cause the impedance of the external cavity 58 and therefore the resonance frequency, to change.

Figure 9:
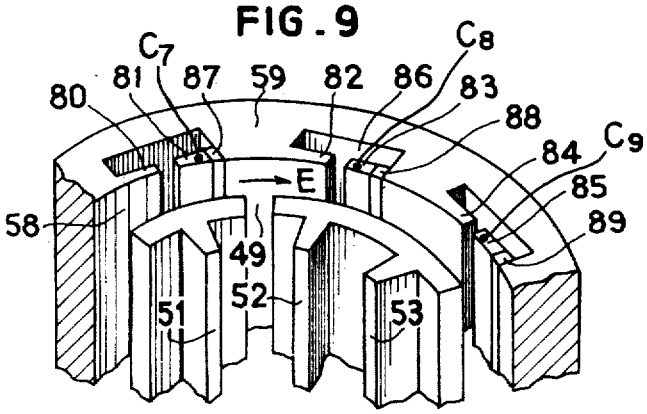
FIG. 9 is a schematic perspective view of a variant coaxial magnetron anode improved in accordance with the invention.

FIG. 9 illustrates a variant embodiment of a coaxial magnetron anode, in which the external cavity 58 comprises controllable multipactor elements 80, 81, 82, 83, 84 and 85.

These elements are arranged on the external cylindrical wall 59 of the magnetron.

Slote 86 are formed longitudinally in said wall and open into the cavity 58 through a narrow slot the lips of which constitute the electrodes 80 to 85 of the multipactor elements. One electrode of each element 81, 83 and 85, is electrically insulated from the wall 59 by an insulator 87, 88 and 89 respectively; the control voltages are applied to these electrodes through connection C7, C8, C9.

In this variant embodiment, the high frequency electric field responsible for the multipactor discharges is perpendicular to the magnetic field of the magnetron but, since the length of the multipactor elements is long in this case (distance between the two megnetron flanges), the discharges can nevertheless be intense.

What is claimed is:

1. In a magnetron having the anode cavities of a magnetron oscillator, at least a multipactor element disposed in the resonant space of one at least of said cavities, said multipactor element comprising two parallel electrodes facing each other and capable of emitting secondary electrons with a secondary emission coefficient $\delta$ greater than unity, said multipactor element being so dimensioned and positioned in said resonant space that the high frequency electric wave developed in said anode when operating provides between said electrodes of said multipactor element, a high frequency electric field perpendicular to said electrodes and gives reside to the occurrence there of a variable multipactor discharge modifying the resonant frequency of said resonant space.

2. In a magnetron according to claim 1, means for applying between the electrodes of said multipactor element a variable direct control voltage for controlling said discharge of said multipactor element.

3. In magnetron according to claim 1, means for applying between the electrodes of said multipactor element a variable magnetic field having at least one component parallel to said electrodes, for controlling said discharge of said multipactor element.

4. A magnetron according to claim 1, the anode of which is formed by resonant cavities disposed side by side inside a conductive cylindrical wall, wherein the conductive radial parts of the anode which separate neighbouring cavities are not in contact, at least at one of the two extremities of the magnetron, with that flange of the magnetron which closes the internal anode space at said extremity, said multipactor elements being arranged between said flange and the faces of said radial parts which are facing said flange.

5. A magnetron according to claim 4, wherein a first electrode of each multipactor element is arranged on said face of said conductive parts of the anode, in electrical contact therewith, whilst the second electrode is attached to said flange opposite said first electrode, being electrically insulated from said flange.

6. A magnetron according to claim 5, wherein said second electrode of each multipactor element is attached to said flange by means of an insulator traversed by a conductor, said conductor having applied on it, when said magnetron is operating, a variable direct control voltage for controlling said discharge of said multipactor element.

7. A magnetron according to claim 5, wherein said second electrode of each multipactor element is attached to said flange through the medium of an insulator surrounded by an insulated coil capable of generating between the electrodes of said multipactor element, when said magnetron is operating, a variable magnetic field having at least one component parallel to said electrodes, for controlling said discharge of said multipactor element.

8. A magnetron according to claim 1, further comprising means for applying between the electrodes of said multipactor element a variable direct control voltage for controlling said discharge of said multipactor element.

9. A magnetron according to claim 8, the anode of which is formed by resonant cavities arranged side-by-side inside a cylindrical wall and seprated by vanes, wherein the two electrodes of each multipactor element are respectively disposed upon the mutually opposite faces of two vanes defining a cavity, a first of said two electrodes being in electrical contact with the vane on which it is disposed, whilst the second is attached to its vane through the medium of an insulator and is supplied with said control voltage.

10. A magnetron according to claim 8, the anode of which is formed by resonant cavities arranged side-by-side inside a cylindrical wall and separated by vanes, and which is equipped with an auxiliary line likewise comprising vanes fixed to a ring, said line coupling neighbouring cavities together in pairs, wherein the multipactor elements have their two electrodes disposed respectively on mutually opposite parts of the anode vanes and the auxiliary line, said control voltage being applied to said auxiliary line.

11. A magnetron according to claim 8, the anode of which comprises resonant cavities arranged side-by-side inside a cylindrical wall, and an external cavity defined between said wall and a second wall concentric therewith, the external cavity surrounding said internal cavities and being coupled therewith within a coaxial structure, wherein multipactor elements are arranged in said external cavity.

12. A magnetron according to claim 8, the anode of which comprises resonant cavities arranged side-by-side inside a cylindrical wall, and an external cavity defined between said wall and a second wall concentric therewith, said external cavity surrounding the internal cavities with which it is coupled within a coaxial structure, wherein multipactor elements are arranged in said second wall.

* * * * *